US009711865B2

(12) United States Patent
Liu

(10) Patent No.: US 9,711,865 B2
(45) Date of Patent: Jul. 18, 2017

(54) DUAL POLARIZATION ARRAY ANTENNA AND RADIATION UNITS THEREOF

(71) Applicant: Comba Telecom Technology (Guangzhou) Ltd., Guangzhou (CN)

(72) Inventor: Peitao Liu, Guangzhou (CN)

(73) Assignee: COMBA TELECOM TECHNOLOGY (GUANGZHOU) LTD., Guangzhou (CN)

( * ) Notice: Subject to any disclaimer, the term of this patent is extended or adjusted under 35 U.S.C. 154(b) by 0 days.

(21) Appl. No.: 14/896,997

(22) PCT Filed: Apr. 28, 2014

(86) PCT No.: PCT/CN2014/076358
§ 371 (c)(1),
(2) Date: Dec. 9, 2015

(87) PCT Pub. No.: WO2014/198165
PCT Pub. Date: Dec. 18, 2014

(65) Prior Publication Data

US 2016/0134023 A1 May 12, 2016

(30) Foreign Application Priority Data

Jun. 9, 2013 (CN) ..... 2013 1 0229651

(51) Int. Cl.
*H01Q 19/10* (2006.01)
*H01Q 1/24* (2006.01)
(Continued)

(52) U.S. Cl.
CPC ..... *H01Q 19/108* (2013.01); *H01Q 1/246* (2013.01); *H01Q 9/28* (2013.01); *H01Q 15/242* (2013.01); *H01Q 21/08* (2013.01); *H01Q 21/26* (2013.01)

(58) Field of Classification Search
CPC ..... H01Q 21/26; H01Q 21/08; H01Q 19/108; H01Q 15/242; H01Q 9/28
See application file for complete search history.

(56) References Cited

U.S. PATENT DOCUMENTS 6,025,812 A * 2/2000 Gabriel ..... H01Q 1/523 343/767
6,195,063 B1 * 2/2001 Gabriel ..... H01Q 1/523 343/700 MS (Continued)

FOREIGN PATENT DOCUMENTS

CN 101361228 A 2/2009
CN 103715519 A 9/2014

(Continued)

OTHER PUBLICATIONS

International Search Report Application No. PCT/CN2014/076358 Completed Jul. 12, 2014; Mailed Jul. 29, 2014.
Written Opinion of PCT Mailed Jul. 29, 2014 11 Pages.

*Primary Examiner* — Hoang Nguyen
(74) *Attorney, Agent, or Firm* — The Roy Gross Law Firm, LLC; Roy Gross

(57) ABSTRACT

A dual polarization array antenna having a plurality of radiation units disposed in an array on a reflecting board of the dual polarization array antenna. Each radiation unit is provided with two pairs of radiation oscillators mounted in an orthogonal polarization position. This greatly improves the consistency of radiation performance between two polarizations of the array antenna, and improves the polarization isolation degree of the array antenna.

20 Claims, 5 Drawing Sheets

(51) Int. Cl.

| | |
|---|---|
| ***H01Q 9/28*** | (2006.01) |
| ***H01Q 21/08*** | (2006.01) |
| ***H01Q 21/26*** | (2006.01) |
| ***H01Q 15/24*** | (2006.01) |

(56) References Cited

U.S. PATENT DOCUMENTS 6,831,615 B2 * 12/2004 Gottl ..... H01Q 1/246
343/797
7,639,198 B2 * 12/2009 Timofeev ..... H01P 1/184
343/795

FOREIGN PATENT DOCUMENTS

JP 2002084133 A 3/2002
JP 2005286459 A 10/2005

* cited by examiner

DUAL POLARIZATION ARRAY ANTENNA AND RADIATION UNITS THEREOF

FIELD OF THE INVENTION

The present invention relates to the field of mobile communications antenna and more particularly, to a dual polarization array antenna and radiation units thereof.

BACKGROUND

For a conventional dual polarization radiation unit, it is typical that two polarized radiation oscillators have the consistent structural size and shape. Moreover, each radiation oscillator is disposed in a same plane. In other words, the two polarized radiation oscillators will overlap each other if rotated 90 degree relative to each other. Though this design to certain extent improves radiation performance consistency of two polarizations, considering avoidance of interference caused by power feeding, rather than disposed in a same plane, feeding ports of two polarizations have to be disposed in different planes. Due to difference in height of the feeding ports and difference in other correspondingly produced boundary conditions, radiation performance value of the two polarizations of an array antenna consisted of above mentioned several consistent radiation units will show certain difference.

With the continued widening of working frequency of mobile antenna, in particular when operated at ultra wide frequency (for example at 1710~2690 MHz), inconsistency of two polarizations becomes significant for either single radiation unit or array antenna. For instance, at a same frequency, important parameters of two polarizations such as H-Plane Half Power beam-width, front to rear ratio, cross polarization discrimination, polarization consistency, and H-plane beam deflection exhibit obvious inconsistency. In addition, this kind of inconsistency will be increased with increase of electrical down-tilt angle of electrically adjustable antenna and is difficult to be eliminated.

At present, to improve network quality and uniform covering of uplink and downlink of network by network operators, high requirements have been proposed for consistency of radiation performance of two polarizations of base station antenna. Radiation units and array antenna consisted of them will almost not meet these requirements of network operators.

If the radiation oscillators of two polarizations are located in a plane at the same height, coupling between two polarizations in a single radiation unit will be increased, and coupling between two polarizations of the array antenna will be increased as well, thus resulting in difficulty in improvement of isolation of wide frequency band array antenna.

Given above situations, person of the art faces challenges on how to maintain uniformity of both radiation performance and isolation of two polarizations.

SUMMARY OF THE INVENTION

One object of the invention is to provide a dual polarization array antenna for improving uniformity of both radiation performance and isolation of two polarizations.

Another object of the invention is to provide a dual polarization radiation unit which forms the dual polarization array antenna aforementioned.

A dual polarization array antenna includes a plurality of radiation units disposed in an array on a reflecting board of the dual polarization array antenna, each radiation unit being provided with two pairs of radiation oscillators mounted in an orthogonal polarization position.

At least one radiation unit is used as a first radiation unit, a first pair of the radiation oscillators of the first radiation unit is used for radiating a first polarization signal, and a second pair of radiation oscillators thereof is used for radiating a second polarization signal;

At least one radiation unit is used as a second radiation unit, a first pair of the radiation oscillators of the second radiation unit is used for radiating a second polarization signal, and a second pair of radiation oscillators thereof is used for radiating a first polarization signal; and On a perpendicular direction of the reflecting board and based on the reflecting board, the first pairs of radiation oscillators of the first radiation unit and the second radiation unit are higher than the second pairs of radiation oscillators.

A dual polarization radiation unit, comprising two pairs of radiation oscillators mounted in an orthogonal polarization position, one pair of the radiation oscillators being used for radiating signal of one polarization, while the other pair of the radiation oscillators being used for radiating signal of another polarization. A reflecting board on which the radiation unit is mounted is taken as datum; along said vertical direction, one pair of radiation oscillators are higher than the other pair of radiation oscillators.

The present invention has the following good effects.

At first, two pairs of radiation oscillators of the dual polarization radiation unit for radiating signals of two polarizations are disposed in first and second space layers with different height respectively, thus improving isolation between two polarizations, and increasing non-relevance between two polarizations.

Secondly, as the two pairs of radiation oscillators of the above radiation unit locate in space layers of different height, non-relevance between two polarizations of the radiation unit is enhanced.

Thirdly, inconsistency between two polarizations of the first radiation unit can counterbalance inconsistency between two polarizations of the second radiation unit, thereby greatly increasing radiation performance consistency of polarizations of the entire array antenna. As a result, H-Plane Half Power beam-width, cross polarization discrimination and the like are also improved.

Moreover, as the isolation of the first and second radiation units and is quietly higher than a general radiation unit, the overall isolation of the array antenna is also increased.

DETAILED DESCRIPTION

A dual polarization array antenna and radiation units thereof will be described in greater detail in conjunction with accompanied FIGS. 1-15 and various embodiments of the invention.

A dual polarization array antenna includes a reflecting board 30 on which a plurality of radiation units. It is noted that as used herein, the term"a plurality of" means either odd number of or even number of. Each radiation unit is a dual polarization radiation unit having two pairs of radiation oscillators mounted in an orthogonal polarization position, each pair of the oscillators is used for radiating signal of one kind polarization.

Figure 1:
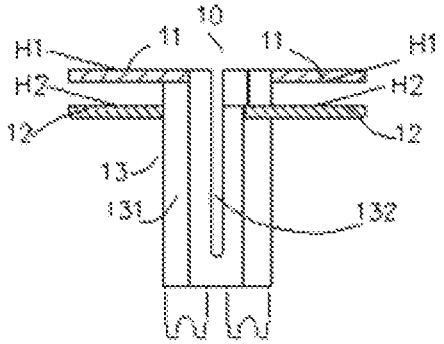
FIG. 1 shows a front view of a first radiation unit of a dual polarization array antenna according to one embodiment of the invention.
Figure 2:
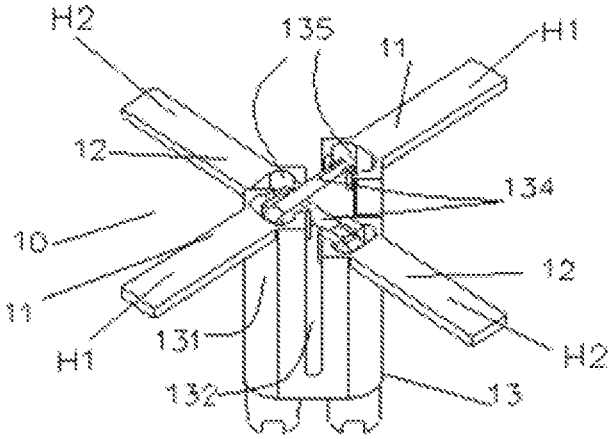
FIG. 2 shows a perspective view of a first radiation unit of a dual polarization array antenna according to one embodiment of the invention.

As shown in FIGS. 1-2, at least one radiation unit has the following construction and shape.

One radiation unit is defined as a first radiation unit 10. One pair of radiation oscillators of the unit 10 serves to radiate signal of a first polarization. For example, for a ±45° dual polarization radiation unit, +45° polarized signal may be radiated and accordingly, this pair of radiation oscillators is defined as a first pair of radiation oscillators 11 and, this pair of radiation oscillators 11 locates in a first space layer H1. Another pair of radiation oscillators of the radiation unit 10 is for radiation of signal of a second polarization. For example, for a ±45° dual polarization radiation unit, −45° polarized signal may be radiated and accordingly, this pair of radiation oscillators is defined as a second pair of radiation oscillators 12 and, this pair of radiation oscillators 12 locates in a second space layer H2. It is noted that the above space layers H1 and H2 are in fact virtual and only for illustrating shape.

The reflecting board 30 is taken as datum. Along a vertical direction of the board 30, the first space layer H1 is at least partially higher than the second space layer H2. Specifically, the first space layer H1 is separated from the second space layer H2 along the vertical direction of the board 30. In addition, the first space layer H1 is entirely higher than the second space layer H2. Or, the first space layer H1 may partially overlaps the second space layer H2 along the vertical direction of the board 30 and, the top surface of the first space layer H1 is higher than that of the second space layer H2.

The first radiation unit 10 includes a balun 13 for physically supporting two pairs of radiation oscillators 11, 12. In particular the balun 13 may be a post. In this balun 13, a slit 132 is defined and extended downwardly along a bisector of an angle formed by intersection of two adjacent radiation oscillators. The slit 132 is intended for realizing shifting of power feeding between unbalanced coaxial cable and balanced radiation oscillators. Each slit 132 has a length of a quarter of working wavelength of central working frequency.

On the balun 13, a balun arm 131 is disposed in a region between two adjacent slits 132. A feeding port 135 is formed on the balun arm 131. Two feeding ports 135 of the same polarization are at the same height. The feeding ports 135 of the same polarization have the function of connecting a feeding sheet 134 which works to feeding power. The feeding sheet 134 is isolated from the balun arm 135 by an insulated dielectric block so as to realize isolation therebetween. The feeding ports 135 of the first polarization are higher than feeding ports 135 of the second polarization. As such, the feeding sheet 134 connecting the two feeding ports 135 of the first polarization is also higher than the feeding sheet 134 connecting the two feeding ports 135 of the second polarization. The feeding sheets 134 of two polarizations cross each other and a distance is maintained therebetween along the vertical direction of the reflecting board 30, thus further reducing feeding interference between two polarizations of the first radiation unit 10.

Moreover, for meeting specific requirements of antenna performance, protruded branches may be formed on the balun arm 131 for adjusting standing wave of the radiation unit. As the first space layer H1 of the radiation unit 10 is at least partially higher than the second space layer H2 along the vertical direction of the reflecting board 30, the height of balun arms 131 of corresponding radiation oscillators varies.

The shape of respective radiation oscillators of the first radiation unit 10 projected on the reflecting board 30 may be rectangular, circle, diamond, triangle, circular shape or other irregular shape. The radiation oscillator 10 may be formed by any one of the following means: solid, cutting off, forming branches locally, forming dielectric locally, partially protruding, or partially recessing. The shape and fabrication of the radiation oscillator 10 may be determined based on radiation performance of the antenna, in consideration of the reflecting board 30. The present invention is not limited to this embodiment.

Take the reflecting board 30 as the datum. The pair of radiation oscillators 11 may have the same height along the vertical direction of the board 30 as shown in FIG. 1. Alternatively, they may have different height when located in two sub layers H11, H12 of different height of the first space layer H1, just as denoted by FIG. 4. The second pair of radiation oscillators 12 may have the same height along the vertical direction of the board 30 as shown in FIG. 1. Alternatively, they may have different height when located in two sub layers H21, H22 of different height of the second space layer H2, just as denoted by FIG. 4.

As shown in FIG. 1, the radiation aperture plane of the first and second pairs of radiation oscillators 11 and 12 is parallel with the surface of the reflecting board 30. This radiation aperture plane is one side of the radiation oscillators 11 and 12 opposite to the reflecting board 30.

Figure 5:
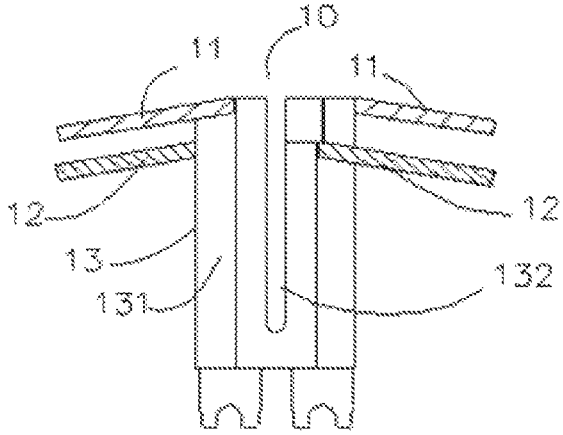
FIG. 5 shows a front view of another one of the first radiation units of a dual polarization array antenna according to one embodiment of the invention.

Or, the radiation aperture plane of the first and second pairs of radiation oscillators 11 and 12 may be inclined with respect to the reflecting board 30. In particular, one end of each of the first and second pairs of radiation oscillators 11 and 12 is secured with the balun arm 131. If the top portion of the balun arm 131 is parallel with the reflecting board 30, another end of each of the first and second pairs of radiation oscillators 11 and 12 is curved and inclined towards the reflecting board 30, as shown in FIG. 5, or inclined away from the reflecting board 30. If the top portion of the balun arm 131 is inclined relative to the reflecting board 30, the first and second pairs of radiation oscillators 11 and 12 is kept erect and inclined towards or away from the reflecting board 30.

Figure 6:
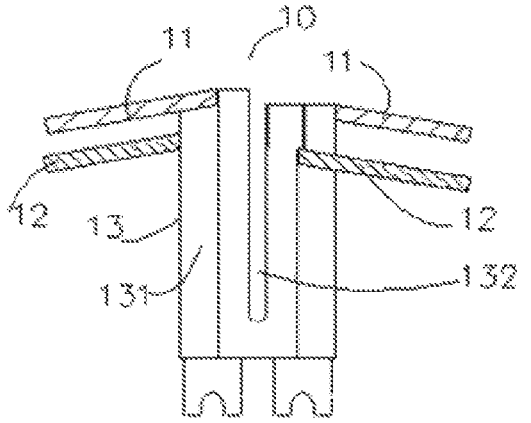
FIG. 6 shows a front view of another one of the first radiation units of a dual polarization array antenna according to one embodiment of the invention.
Figure 7:
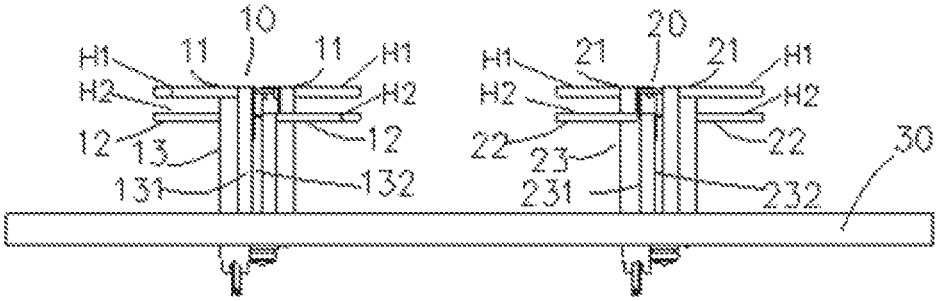
FIG. 7 shows a front view of adjacently disposed first and second radiation units of a dual polarization array antenna according to one embodiment of the invention.
Figure 8:
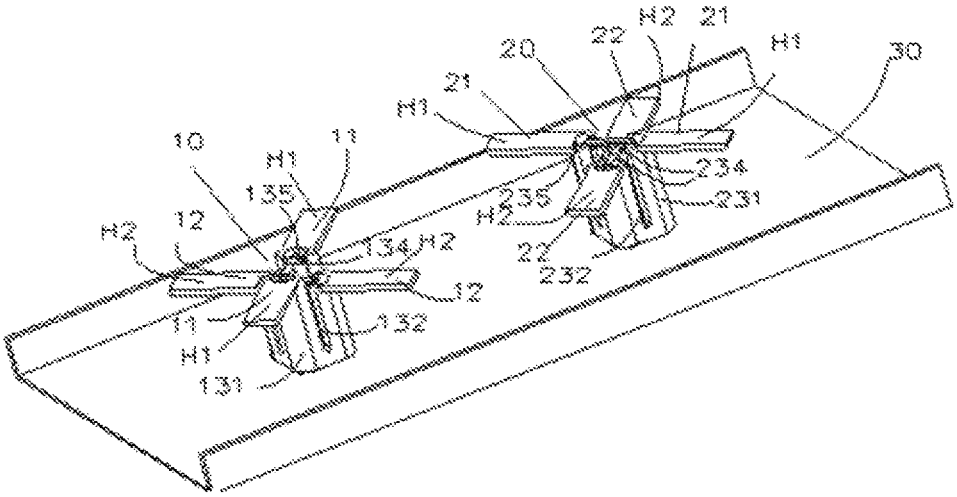
FIG. 8 shows a perspective view of adjacently disposed first and second radiation units of a dual polarization array antenna according to one embodiment of the invention.
Figure 9:
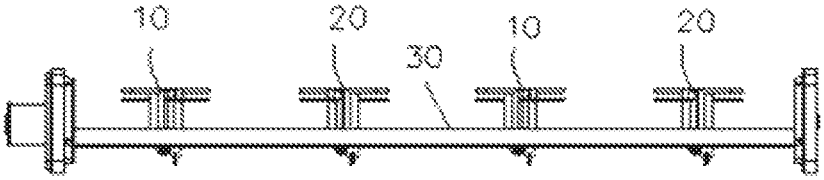
FIG. 9 shows a structural view of a dual polarization array antenna according to one embodiment of the invention.

Furthermore, the radiation oscillators may have the same or different height. The radiation aperture plane of these oscillators may be parallel with the reflecting board 30 or be inclined with it. As shown in FIG. 6, the radiation oscillators are at the different height and are inclined towards the reflecting board 30.

Regarding the first radiation unit 10, as the first space layer H1 into which the first pair of radiation oscillators 11 locates is at least partially higher than the second space layer H2 into which the second pair of radiation oscillators 12 locates along the vertical direction of the reflecting board 30, the height of balun arms 131 of corresponding radiation oscillators varies. Correspondingly, the balun arms 131 corresponding to respective radiation oscillators are also of the different height. In addition, the height of feeding ports 135 of different polarization is also different. Any difference in height of space layers, balun arms or feeding ports or their combination may increase difference between two polarizations of the first radiation unit 10, and reduce coupling between two polarizations, thus leading to high isolation.

At least one radiation unit of the dual polarization array antenna has the following structure and shape. One radiation unit is defined as a second radiation unit 20. The differences of unit 20 over the first radiation unit 10 will be described in detail, and other identical features will be omitted here from due to similar structure, shape and technical effects of the second radiation unit 20 with the first radiation unit 10.

Figure 3:
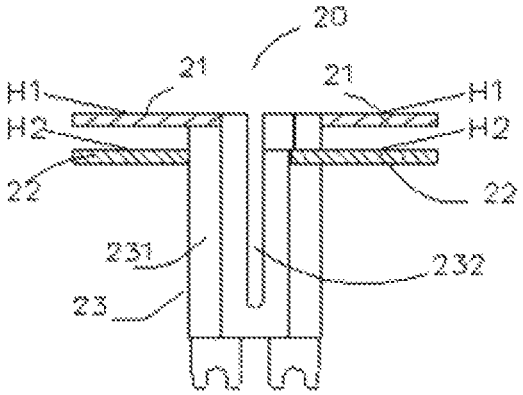
FIG. 3 shows a front view of a second radiation unit of a dual polarization array antenna according to one embodiment of the invention.
Figure 4:
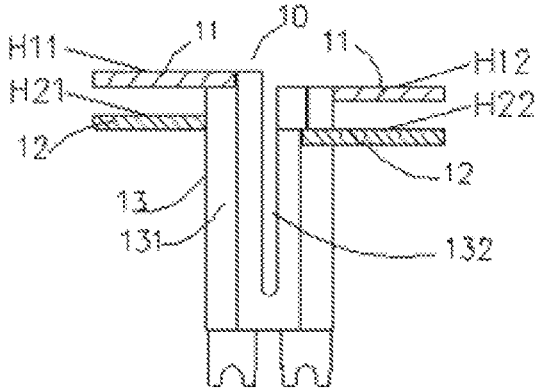
FIG. 4 shows a front view of another one of the first radiation units of a dual polarization array antenna according to one embodiment of the invention.

As indicated in FIG. 3, one pair of radiation oscillators of the unit 20 serves to radiate signal of a first polarization. For example, for a ±45° dual polarization radiation unit, +45° polarized signal may be radiated and accordingly, this pair of radiation oscillators is defined as a second pair of radiation oscillators 22 and, this pair of radiation oscillators 22 locates in a second space layer H2. Another pair of radiation oscillators of the radiation unit 20 is for radiation of signal of a second polarization. For example, for a ±45° dual polarization radiation unit, −45° polarized signal may be radiated and accordingly, this pair of radiation oscillators is defined as a first pair of radiation oscillators 21 and, this pair of radiation oscillators 21 locates in a first space layer H1.

A feeding port 235 with a second polarization of the second radiation unit 20 is higher than the feeding port 235 with a first polarization. As such, a feeding sheet 234 for connecting two feeding ports 235 of the second polarization together is higher that the feeding sheet 234 for connecting two feeding ports 235 of the first polarization together. The feeding sheets 234 of different polarization cross each other and a distance is maintained therebetween along the vertical direction of the reflecting board 30, thus further reducing feeding interference between two polarizations of the second radiation unit 20.

Regarding the second radiation unit 20, as the first space layer H1 into which the first pair of radiation oscillators 21 locates is at least partially higher than the second space layer H2 into which the second pair of radiation oscillators 22 locates along the vertical direction of the reflecting board 30, the height of balun arms 231 of corresponding radiation oscillators varies. In addition, the height of feeding ports 235 of different polarization is also different. Any difference in height of space layers, balun arms or feeding ports or their combination may increase difference between two polarizations, and reduce coupling between two polarizations, thus leading to high isolation.

In this dual polarization array antenna, a symmetrical reference line is presented on the reflecting board 30. The plurality of radiation units of the antenna is arranged along said reference line. The symmetry means symmetry about an axis or a center. In addition this reference line is only virtual and indeed not disposed on the reflecting board 30.

Figure 12:
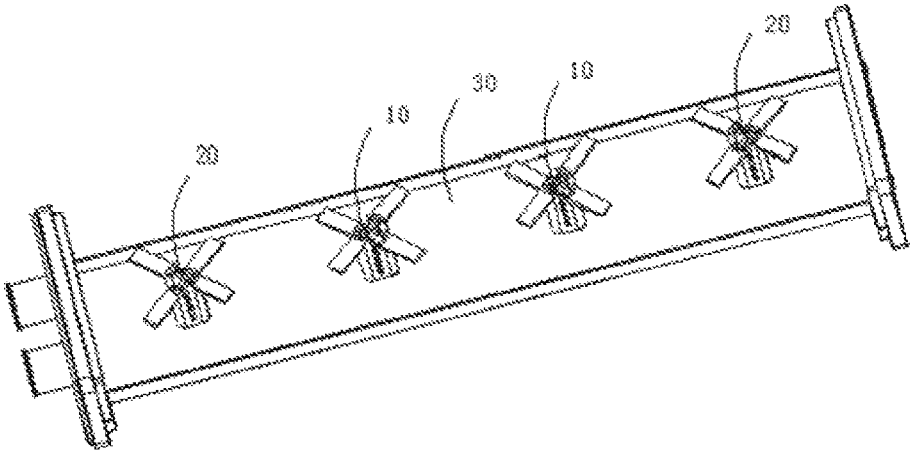
FIG. 12 shows arrangement of the first and second radiation units of a dual polarization array antenna according to another embodiment of the invention.
Figure 13:
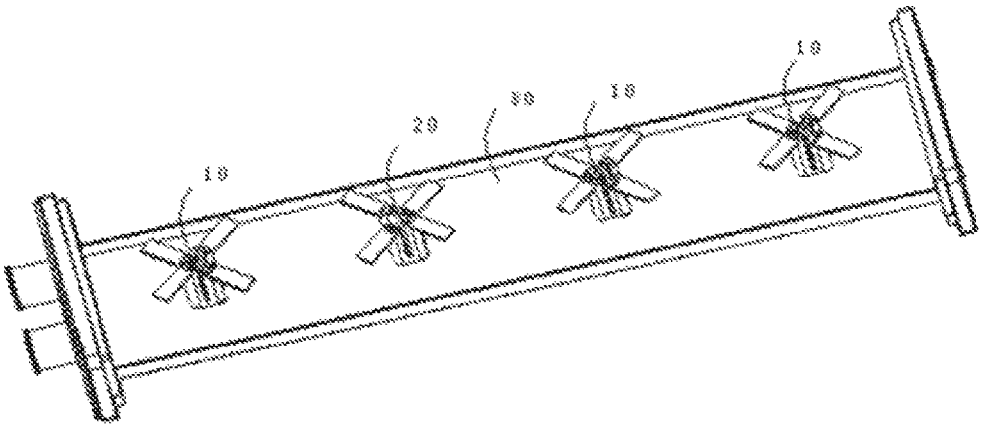
FIG. 13 shows arrangement of the first and second radiation units of a dual polarization array antenna according to another embodiment of the invention.
Figure 14:
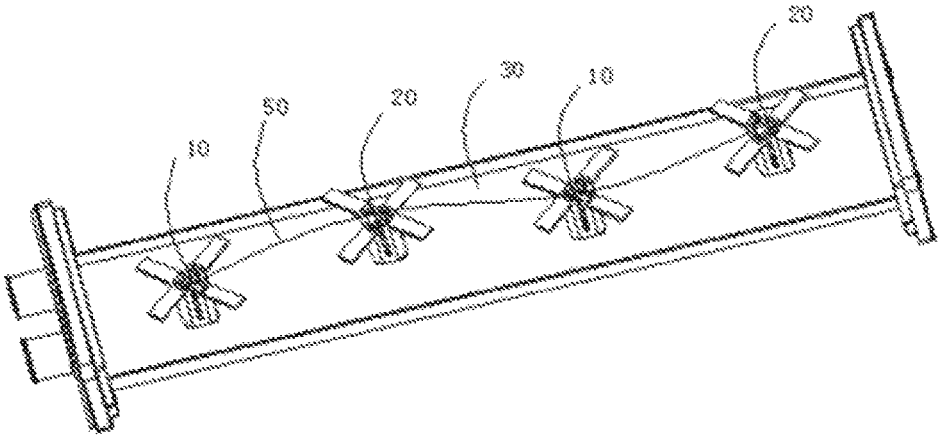
FIG. 14 shows arrangement of the first and second radiation units of a dual polarization array antenna according to another embodiment of the invention.

The virtual reference line may be straight lines as shown in FIGS. 10-13, or curved line of S-shape 50 as shown in FIG. 14. This may be freely selected by person of the art.

On this reflecting board 30 and along the virtual reference line, only the first radiation unit 10 and second radiation unit 20 may be disposed. Or, in addition to the first radiation unit 10 and second radiation unit 20, a third radiation unit with different structure from the units 10 and 20 and for radiating signals of two polarizations may be provided.

The radiation unit normally is centrally symmetrical. The mounting location of the radiation unit on the reference line may be determined by geometry center of the unit normally projected on a projection plane of the reflecting board 30.

In consistency between two polarizations of the first radiation unit 10 may counterbalance inconsistency between two polarizations of the second radiation unit 20, thereby improving consistency in radiation performance of different polarizations of the entire antenna. As a result, H-Plane Half Power beam-width, cross polarization discrimination and the like are also improved. Moreover, as the isolation of the first and second radiation units 10 and 20 is quietly higher than a general radiation unit, the overall isolation of the array antenna is also increased.

In this embodiment, no matter whether the number of the first radiation units 10 is identical to that of the second radiation units 20, cancellation of inconsistency of one polarization is at least partially realized as long as there are a first radiation unit 10 and second radiation unit 20.

In this embodiment, to better cancel in consistency of one polarization between the first radiation unit 10 and second radiation unit 20, as shown in FIG. 14, on the reflecting board 30, at least part of first radiation units 10 and corresponding number of second radiation units 20 are centrally symmetrical about the geometry center (that is, symmetrical center point) of the virtual reference line. Furthermore, a first radiation unit 10 and a corresponding second radiation unit 20 are centrally symmetrical about the geometry center.

Figure 10:
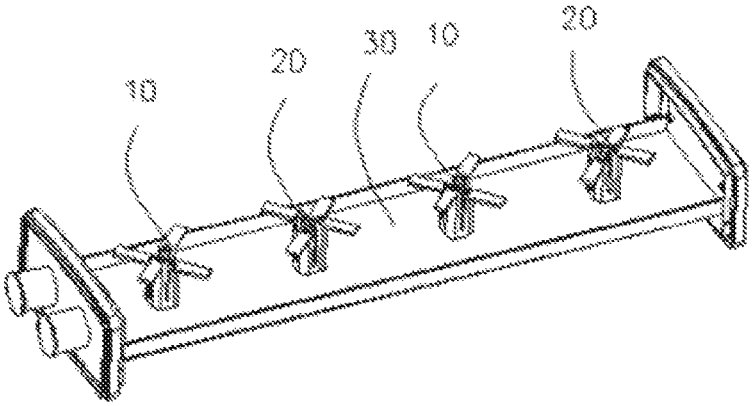
FIG. 10 shows arrangement of the first and second radiation units of a dual polarization array antenna according to one embodiment of the invention.

Alternatively, as shown in FIG. 10 or 13, on the reflecting board 30, at least part of first radiation units 10 and corresponding number of second radiation units 20 are symmetrical about a symmetrical axis of the virtual reference line. Furthermore, a first radiation unit 10 and a corresponding second radiation unit 20 are symmetrical about the symmetrical axis.

Alternatively, as shown in FIG. 10 or 13, on the reflecting board 30, at least part of first radiation units 10 and corresponding number of second radiation units 20 are symmetrical about a geometry center of the virtual reference line. Furthermore, a first radiation unit 10 and another first radiation unit 10 are centrally symmetrical about the geometry center, while a second radiation unit 20 and another second radiation unit 20 are centrally symmetrical about the geometry center.

Figure 11:
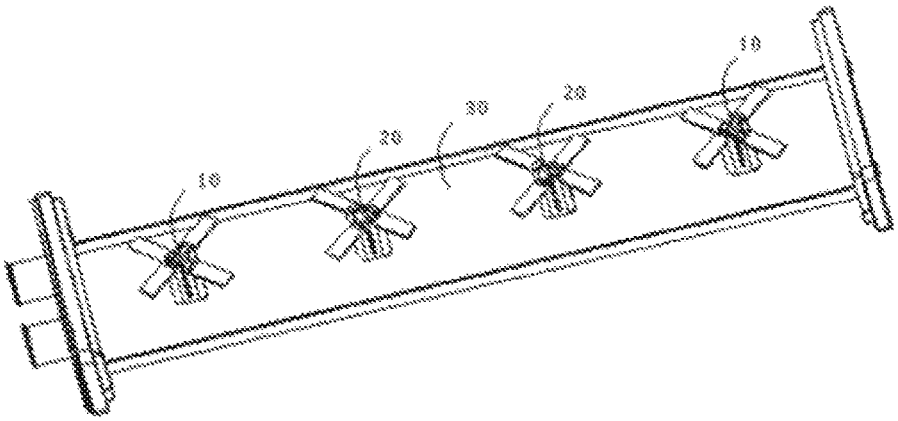
FIG. 11 shows arrangement of the first and second radiation units of a dual polarization array antenna according to another embodiment of the invention.

Alternatively, as shown in FIG. 11 or 12, on the reflecting board 30, at least part of first radiation units 10 and corresponding number of second radiation units 20 are symmetrical about a symmetrical axis of the virtual reference line. Furthermore, a first radiation unit 10 and another first radiation unit 10 are symmetrical about the symmetrical axis of the virtual reference line. A second radiation unit 20 and another second radiation unit 20 are also symmetrical about the symmetrical axis of the virtual reference line.

Alternatively, as shown in FIGS. 10-13, on the reflecting board 30, a first radiation unit 10 and a second radiation unit 20 are adjacently arranged along the virtual reference line.

Arrangement manners P1-P6 are given below and these manners may be used along or in combination.

According to manner P1, a first radiation unit 10, a second radiation unit 20, a first radiation unit 10 and a second radiation unit 20 are sequentially arranged on the reflecting board 30 along the straight reference line from left to right or from right to left (as shown in FIG. 10).

According to manner P2, a first radiation unit 10, a second radiation unit 20, a second radiation unit 20 and a first radiation unit 10 are sequentially arranged on the reflecting board 30 along the straight reference line from left to right (as shown in FIG. 11).

According to manner P3, a second radiation unit 20, a first radiation unit 10, a first radiation unit 10 and a second radiation unit 20 are sequentially arranged on the reflecting board 30 along the straight reference line from left to right (as shown in FIG. 12).

According to manner P4, a first radiation unit 10, a second radiation unit 20, a first radiation unit 10 and a first radiation unit 10 are sequentially arranged on the reflecting board 30 along the straight reference line from left to right or from right to left (as shown in FIG. 13).

According to manner P5, a second radiation unit 20, a first radiation unit 10, a second radiation unit 20 and a second radiation unit 20 are sequentially arranged on the reflecting board 30 along the straight reference line from left to right or from right to left.

According to manner P6, a first radiation unit 10, a second radiation unit 20, a first radiation unit 10 and a second radiation unit 20 are sequentially arranged on the reflecting board 30 along the S-curved reference line from left to right or from right to left (as shown in FIG. 14).

The first radiation units 10 and second radiation units 20 are disposed on the reflecting board 30 in a manner by which inconsistency of the same polarization is at least partially eliminated. Specifically, the radiation units of the dual polarization array antenna are consisted of at least a first radiation unit 10 and a second radiation unit 20. Or it may be consisted of at least a first radiation unit 10, at least a second radiation unit 20, and several other types of radiation units. Herein, other types of radiation units are defined as the third radiation units.

Figure 15:
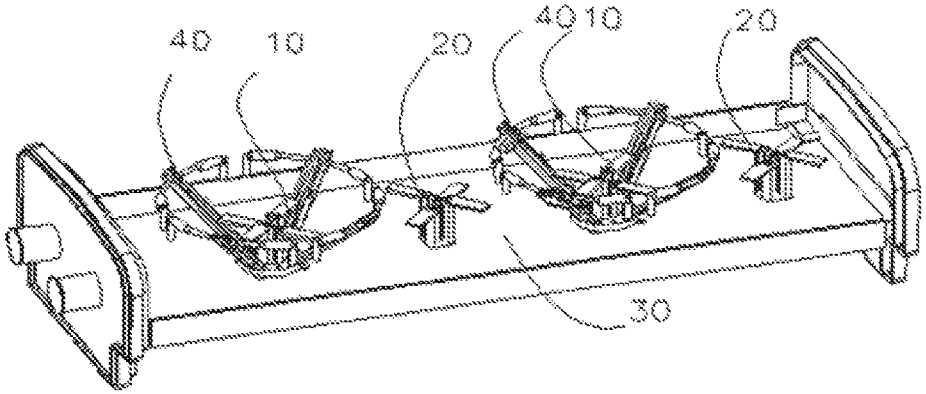
FIG. 15 shows a structural view of a dual frequency dual polarization array antenna according to another embodiment of the invention.

According to another embodiment and as shown in FIG. 15, a dual frequency dual polarization array antenna further includes a low frequency radiation unit 40 into which the first radiation unit 10 is nested. The second radiation units 20 and low frequency radiation units 40 are disposed on the reflecting board 30 along the straight virtual reference line such that equal distance is maintained between adjacent units. Similarly, the second radiation unit 20 may also be nested into a corresponding low frequency radiation unit 40 and form together with the first radiation unit 10 a dual frequency dual polarization array antenna. This antenna has simple construction, is easy to be made, results in low cost, and is easy to be assembled. Moreover, isolation between two polarizations and radiation performance are high.

According to actual requirement, this single or dual frequency dual polarization array antenna may provide isolation bar, isolation board, metal cavity and the like between the radiation units for further improving isolation of the array antenna and adjusting direction pattern.

The terms "first" and "second" as used herein are intended for distinguishing between different components and may not be understood as having limitation to sequence of the components.

Though various embodiments of the invention have been illustrated above, a person of ordinary skill in the art will understand that, variations and improvements made upon the illustrative embodiments fall within the scope of the invention, and the scope of the invention is only limited by the accompanying claims and their equivalents.

What is claimed is:

1. A dual polarization array antenna, comprising a plurality of radiation units disposed in an array on a reflecting board of the dual polarization array antenna, each radiation unit being provided with two pairs of radiation oscillators mounted in an orthogonal polarization position, wherein, at least one radiation unit is used as a first radiation unit, a first pair of the radiation oscillators of the first radiation unit is used for radiating a first polarization signal, and a second pair of radiation oscillators thereof is used for radiating a second polarization signal;

at least one radiation unit is used as a second radiation unit, a first pair of the radiation oscillators of the second radiation unit is used for radiating a second polarization signal, and a second pair of radiation oscillators thereof is used for radiating a first polarization signal; and on a perpendicular direction of the reflecting board and based on the reflecting board, the first pairs of radiation oscillators of the first radiation unit and the second radiation unit are disposed to be higher than the second pair of radiation oscillators.

2. The dual polarization array antenna as recited in claim 1, wherein the first radiation units and second radiation units are disposed on the reflecting board in a manner by which inconsistency of the same polarization is at least partially eliminated.

3. The dual polarization array antenna as recited in claim 1, wherein the plurality of radiation units is arranged along a symmetrical virtual reference line.

4. The dual polarization array antenna as recited in claim 3, wherein the virtual reference line is a straight line or curved line of S-shape.

5. The dual polarization array antenna as recited in claim 3, wherein at least part of first radiation units and corresponding number of second radiation units are symmetrical about the geometry center of the virtual reference line; and a first radiation unit and a corresponding second radiation unit are centrally symmetrical about the geometry center;

or, at least part of first radiation units and corresponding number of second radiation units are symmetrical about a symmetrical axis of the virtual reference line; and a first radiation unit and a corresponding second radiation unit are symmetrical about the symmetrical axis.

6. The dual polarization array antenna as recited in claim 3, wherein at least part of first radiation units and corresponding number of second radiation units are symmetrical about the geometry center of the virtual reference line; and a first radiation unit and another first radiation unit are centrally symmetrical about the geometry center; a second radiation unit and another second radiation unit are centrally symmetrical about the geometry center;

or, at least part of first radiation units and corresponding number of second radiation units are symmetrical about a symmetrical axis of the virtual reference line; and a first radiation unit and another first radiation unit are symmetrical about the symmetrical axis; a second radiation unit and another second radiation unit are symmetrical about the symmetrical axis.

7. The dual polarization array antenna as recited in claim 3, wherein a first radiation unit and a second radiation unit are adjacently arranged along the virtual reference line.

8. The dual polarization array antenna as recited in claim 3, wherein only the first and second radiation units are disposed along said virtual reference line.

9. The dual polarization array antenna as recited in claim 3, wherein a third radiation unit with different structure from the first and second radiation units is disposed along the virtual reference line for radiating signals of two polarizations.

10. The dual polarization array antenna as recited in claim 3, wherein the total number of the radiation units is even or odd number.

11. The dual polarization array antenna as recited in claim 1, wherein the reflecting board is taken as datum; along a vertical direction of the board, the first pair of radiation oscillators of the first or second radiation unit locates in a virtual first space layer, while the second pair of radiation oscillators of the first or second radiation unit locates in a virtual second space layer; and along said vertical direction, the first space layer is at least partially higher than the second space layer such that along said vertical direction of the reflecting board the first radiation oscillators are higher than the second radiation oscillators.

12. The dual polarization array antenna as recited in claim 11, wherein the reflecting board is taken as datum; along a vertical direction of the board, a pair of radiation oscillators, for radiating signal of same polarization and located in the same space layer, of the first or second radiation unit, each has two oscillator arms of different vertical height.

13. The dual polarization array antenna as recited in claim 11, wherein the first space layer and second space layer are partially overlapped with each other or completely separated from each other.

14. The dual polarization array antenna as recited in claim 11, wherein each pair of the first and second pairs of radiation oscillators of the first or second radiation unit has a radiation aperture plane located away from a surface of the reflecting board; and each radiation aperture plane is parallel with the surface of the reflecting board.

15. The dual polarization array antenna as recited in claim 11, wherein each pair of the first and second pairs of radiation oscillators of the first or second radiation unit has a radiation aperture plane located away from a surface of the reflecting board; and each radiation aperture plane is inclined relative to the surface of the reflecting board.

16. The dual polarization array antenna as recited in claim 15, wherein the first and second pairs of radiation oscillators of the first or second radiation unit are supported on the reflecting board through a balun; one end of each of the first and second pairs of radiation oscillators is secured with the balun, while the other end thereof is close to or away from the reflecting board such that a corresponding radiation aperture plane is inclined.

17. A dual polarization radiation unit, comprising two pairs of radiation oscillators mounted in an orthogonal polarization position, one pair of the radiation oscillators being used for radiating signal of one polarization, while the other pair of the radiation oscillators being used for radiating signal of another polarization, wherein a reflecting board on which the radiation unit is mounted is taken as datum; along a vertical direction of the board, one pair of radiation oscillators locates in a virtual first space layer, while the other pair of radiation oscillators locates in a virtual second space layer; and along said vertical direction, the first space layer is at least partially higher than the second space layer such that along said vertical direction of the reflecting board the one pair of radiation oscillators are higher than the other pair of radiation oscillators, wherein each radiation oscillator is supported on the reflecting board through a balun; one end of each radiation oscillators is secured with the balun, while the other end thereof is close to or away from the reflecting board such that a corresponding radiation aperture plane is inclined.

18. The dual polarization radiation unit as recited in claim 17, wherein the first space layer and second space layer are partially overlapped with each other or completely separated from each other.

19. The dual polarization radiation unit as recited in claim 17, wherein each radiation oscillator has a radiation aperture plane located away from a surface of the reflecting board; and each radiation aperture plane is parallel with the surface of the reflecting board.

20. The dual polarization radiation unit as recited in claim 17, wherein each radiation oscillator has a radiation aperture plane located away from a surface of the reflecting board; and each radiation aperture plane is inclined relative to the surface of the reflecting board.

* * * * *